United States Patent [19]

Clarke

[11] 3,941,383

[45] Mar. 2, 1976

[54] VELCRO PROJECTILE AND TARGET

[76] Inventor: William A. Clarke, 1001 Linden Ave., Erie, Pa. 16505

[22] Filed: Dec. 2, 1974

[21] Appl. No.: 528,675

[52] U.S. Cl. ..... 273/95 R; 273/58 R; 46/DIG. 1; 273/106 R

[51] Int. Cl.[2] ..... A63B 71/02

[58] Field of Search ... 46/DIG. 1; 273/58 R, 58 BA, 273/58 D, 95 R, 102 R, 106 R, 106 B, 106.5 R, 106.5 A, 58 A

[56] References Cited

UNITED STATES PATENTS

| | | | |
|---|---|---|---|
| 2,783,046 | 2/1957 | Lien | 273/58 R |
| 3,032,345 | 5/1962 | Lemelson | 273/95 R |
| 3,176,989 | 4/1965 | Harrison | 273/106 B |
| 3,370,853 | 2/1968 | Feld | 273/106.5 |
| 3,391,933 | 7/1968 | Cooper | 46/DIG. 1 |
| 3,601,406 | 8/1971 | Guisti | 46/DIG. 1 |
| 3,721,447 | 3/1973 | Louderback | 46/DIG. 1 |
| 3,784,201 | 1/1974 | Wyman | 46/DIG. 1 |

FOREIGN PATENTS OR APPLICATIONS

| | | | |
|---|---|---|---|
| 572,507 | 6/1974 | France | 273/95 R |
| 609,705 | 4/1926 | France | 273/106.5 |

OTHER PUBLICATIONS

Golf World, p. 14, 11/17/1961.

*Primary Examiner*—Paul E. Shapiro
*Assistant Examiner*—Marvin Siskind
*Attorney, Agent, or Firm*—Ralph Hammar

[57] ABSTRACT

A game having a projectile coated with burr type material and a target to which the burr material adheres. In a preferred form the projectile is a ball having two wheel elements intersecting in planes at right angles to each other and provided with burr coated rims. A single wheel element may be used as a dart or slingshot projectile.

11 Claims, 10 Drawing Figures

VELCRO PROJECTILE AND TARGET

This invention is a target game having a projectile with one or more rim sections coated with burr type material, an example of which is the textile material commercially available under the trademark "Velcro". The burr material sticks to a target at the point of impact to provide positive scoring information and is easily stripped from the target to provide a clean target surface. The production of the projectile is adapted to automation.

In the drawing

FIG 1. is a plan view of an element of a ball,

Figure 1:
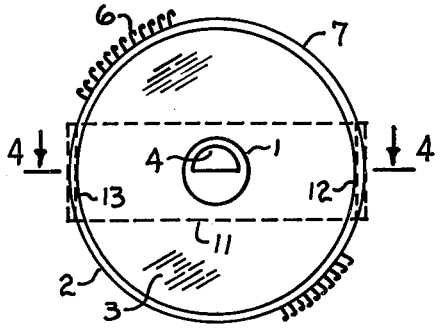
Figure 2:
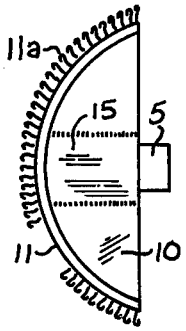
FIG. 2 is a plan view of one of the other elements of the ball.
Figure 4:
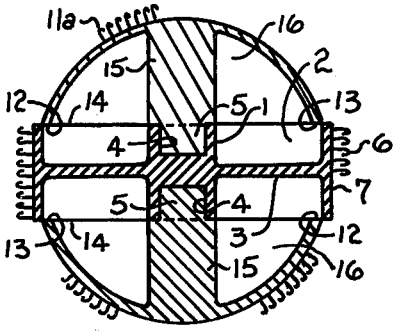
Figure 6:
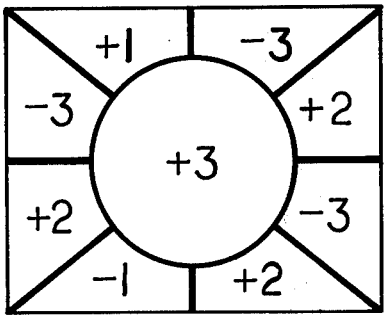
Figure 5:
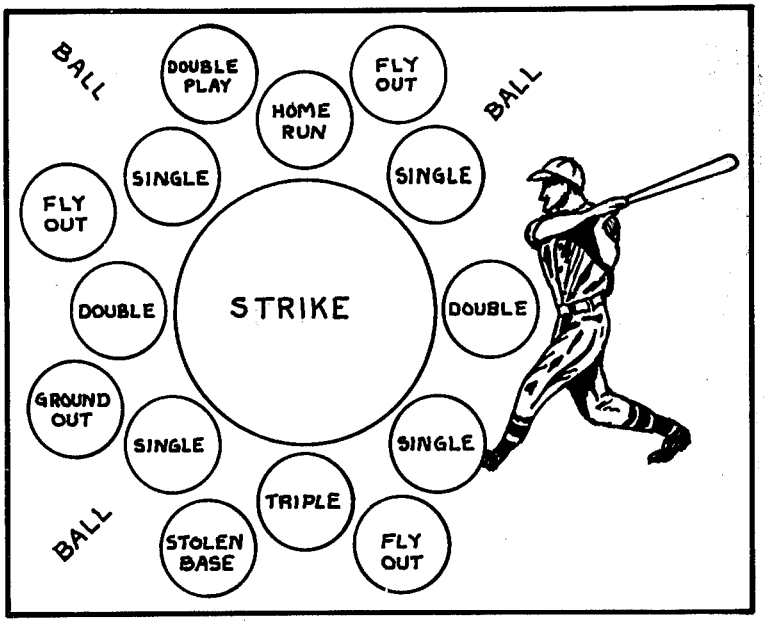
Figure 7:
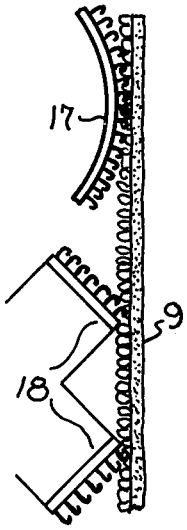
Figure 9:
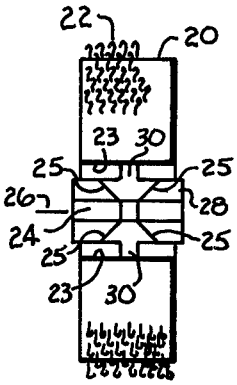
Figure 8:
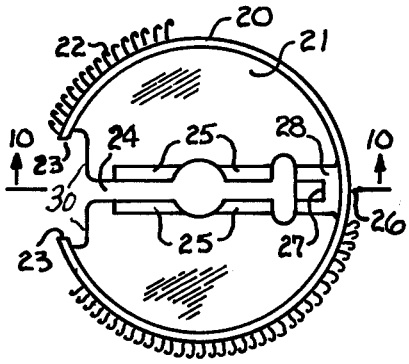
Figure 10:
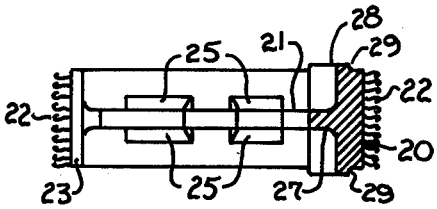

FIG. 4 is a section on line 4—4 of FIG. 1 with the FIG. 2 element assembled thereto, FIGS. 5 and 6 are views of targets, FIG. 7 is a diagramatic view showing the adherence of the burr coated surface to the target, FIG. 8 is a side view of another ball element, FIG. 9 is an elevation of FIG. 8 element, and FIG. 10 is a section on line 10—10 of FIG. 8.

In a preferred form illustrated in the drawings, the projectile is a ball which consists of three parts adapted to injection molding from impact resistant thermoplastics such as high impact styrene, polyethelene, polypropylene, nylon, cryolac, etc.

The part shown in FIG. 1 is in the form of a wheel with a hub 1, a rim or felly 2 and a rim supporting means or structure such as disc 3 between the hub and the rim. In opposite ends of the hub 1 are non circular sockets 4 for receiving complimentary projections 5 on the other parts of the ball. On the outer surface of the rim is a tire 6 of burr material. There is a large body of patent literature describing burr material and adhesives for attaching the burr material to various surfaces.

A convenient form of burr material for the tire 6 is pressure sensitive Velcro tape having a width equal to the width of the rim 2. The tape has a textile backing coated with a pressure sensitive adhesive and a face or pile of closely spaced stiff plastic spines terminating in hook ends. The tape can conveniently be applied by rolling the rim 2 over the length of tape equal to the outside circumference of the rim. As the rim is rolled over the adhesive side of the tape, the required pressure is applied to unite the tape and the rim. Alternately the tape could be wound around the rim.

The outer or hook surface of the tape makes gripping contact with many knit or tufted textiles and also with special gripping Velcro material having a surface or pile consisting of closely spaced plastic loops. The targets shown in FIGS. 5, 6 and 7 have a face 8 of knit nylon and a back 9 of urethane foam.

The target of FIG. 5 has printed legends adapting it to baseball scoring. The FIG. 6 target has legends for conventional scoring with the winner being the first to reach an arbitrary total of, for example, 33.

The disc or wheel 1 could be used by itself as the projectile for either of the targets FIG. 5, 6. It could be thrown as a flying saucer and the part of the tire 6 first contacting the target would be immediately gripped to indicate the score. For this purpose, the hub 1 and socket 4 would not be necessary. The disc 3 and rim 2 could be redesigned to incorporate the aerodynamic effects of flying saucer type projectiles. The cylindrical rim 2 would be retained for ease of application of the burr material and also for improved gripping action. The flat tread of tire 6 maximizes the gripping contact particularly with a target of flexible material such as the foam backed nylon knit of FIG. 7.

Figure 3:
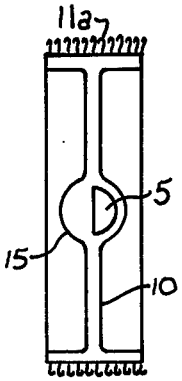
FIG. 3 is an end view of FIG. 2.

In order to convert the disc or wheel element 1–3 a ball type projectile, two of the elements 10 shown in FIGS. 2 and 3 are assembled to opposite ends of hub 1. These elements are aligned in planes at right angles to the plane of the rim 2 by the non circular projections 5 which seat in non circular recesses 4 in opposite ends of hub 1. The elements 10 have rim segments 11 of substantially the same curvature as the rim 2 with ends 12, 13 which when assembled in FIG. 4 abut opposite edges 14 of the rim 2. The elements 10 also have circular bosses 15 which when assembled are in essentially direct continuation with the hub 1. The rim segments 11 are reinforced by a segmental disc section 16. The parts 10 are adapted to injection molded thermoplastic in the same manner as the wheel element. A mold having three cavities could mold all of the parts for a ball in the same molding cycle. The rim segments 11 may be coated with tires 11a of burr material in the same manner as the rim 2. These operations are easily automated. The use of pressure sensitive adhesive is convenient but is not necessary. Other adhesives or fastening means may be used.

The outer or tread surface of the rim 2 and of segmental rim 11 is such that the burr material will easily conform to the backing of the material as it is applied. The backing of the Velcro burr material is easily bendable but is relatively non stretchable. A flat cylindrical surface 7 as illustrated is ideal. A slight crowning as in pulleys can be tolerated. The curvature of the surface as viewed in FIG. 4 should not exceed the ability of the burr material to conform to the surface. The cylindrical outer surface of rim 2 and rim segments 11 should be substantially flat in an axial direction in the sense that the intersection with any plane through the axes of the rim 2 or rim segments 11 is a substantially straight line.

The radius of curvature of the rim 2 and of the segmental rims 11 are the same. Because the ends of the segmental rims contact the rim 2 in planes spaced on opposite sides of the axis of the hub 1 as shown in FIG. 1, it would appear from the section of FIG. 4 that the ball would encounter an objectionable bump when rolled on tires 11*a*. This does not happen and in any event is immaterial because the ball never rolls. As soon as the ball contacts the target, it sticks and does not roll.

When either tire 6 or 11a contacts the target squarely the adhesion to the target is as illustrated at 17 in FIG. 7. When the tires contact the target with the tires in place at an angle of 45° to the target as shown at 18 in FIG. 7, the edge adhesion is ample and would be ample if only a single tire edge made contact with the target. The result is that the ball structure can be thrown or launched like a ball and will stick to the target at the point of contact.

The cost of the ball structure is much less than the cost of truly spherical balls with burr material applied to the outer surface. First, the burr material can only be applied to a spherical surface in spots or in narrow strips where the weakest adhesion is at the edges, the points at which the adhesion should be strongest. The burr material therefore tends to peel off the ball, a process which accelerates once started. Also peeling interferes with the aerodynamic properties destroying the fairness of the game. Second, the application of spots or narrow strips must be by hand. The result is that the cost of application is on the order of four times the cost of complete ball structure of this application.

In FIGS. 8, 9 and 10 is shown a part which may be used as a disc or flying saucer, as a sling shot propelled dart, as the tip or an arrow or dart, or which may be assembled with another like part to form a ball. The part has a rim or felly 20, and a rim supporting structure such as the web or disc 21. The angular extent of the rim is 360° minus the axial width of the rim. On the outer surface of the rim is a tire 22 of burr material. The outer surface of the rim is a flat cylindrical surface substantially the same as the surface 7 and the tire 22 may be tape Velcro with a backing coated with a pressure sensitive adhesive and a pile of burr material. The tape may be applied in the same manner as the tire 6. Extending diametrically across the web 21 in a plane 26 extending through the axis of the rim 20 midway between the ends 23 of the rim is a slot 24 having a width substantially equal to the thickness of the web 21. On opposite sides of the slot are guideways 25 at an angle of substantially 45° to the plane 26. The slot 24 is open at the ends 23 of the rim and has its other end 27 closed by a catch or detent element 28 having detent shoulders 29. When another part identical with that shown in FIG. 8 is rotated 180° and turned into a plane at right angles to the plane 26 with the open ends of the slots 24 aligned and facing each other, pushing the parts together causes the catch 28, 29 of each part to be snapped beneath the ends 23 of the other part. This results in a ball structure assembly having external cylindrical surfaces of burr material the same as the ball illustrated in FIGs. 1–4 inclusive. The ball of FIGS. 8–10 is simpler to make because it is fewer parts. Once assembled the balls of FIG. 1, 4 and 8, 10 are functionally identical.

The part of FIGS. 8–10 may be used alone as a disc or flying saucer. The part of tire 22 first contacting the target would be immediately gripped. The gripping action would be substantially that illustrated in FIG. 7. The disc could be thrown by hand or could be propelled by a launching device such as a sling shot. When used with a sling shot the rubber band of the sling shot would engage surfaces 30 and would propel the dart to the right as viewed in FIG. 8.

The part of FIGS. 8 to 10 may also be used as a tip of an arrow or dart having its shaft suitably fixed in the slot 24. The cylindrical surface of the dart provides a highly efficient target gripping surface which is also blunt and therefore safer.

What is claimed is:

1. A game comprising a ball projectile having two intersecting wheel elements assembled at right angles to each other and coacting to form a ball, each wheel element having a rim with a cylindrical outer surface coated with a tread of burr material, the axes of the cylindrical surfaces intersecting each other at right angles, each wheel element having a recess extending inward from its periphery, the recess in one wheel element extending in a direction opposite the direction in which the recess in the other wheel element extends, and a target against which the projectile is to be propelled, said target being of material to which the burr material adheres upon contact so a burr coated surface of the projectile is adhered to the target at the point at which the surface strikes the target.

2. The game of claim 1 in which the rims terminate in axially spaced circular edges.

3. The game of claim 1 in which each wheel element has a one piece rim.

4. The game of claim 1 in which each wheel element is a disc wheel.

5. The game of claim 1 in which the wheel elements are of impact resistant thermoplastic having rims coated with a tape having a relatively non stretchable backing and a burr like pile.

6. The game of claim 1 in which the slots have interengaging guide surfaces aligning the elements in planes at right angles to each other.

7. A game comprising a ball projectile having two intersecting wheel elements at right angles to each other, each wheel element having a rim with a cylindrical outer surface coated with burr material, the axes of the cylindrical surfaces intersecting each other at right angles, one of the wheel elements having a one piece rim and the other wheel element having a rim in two segmental pieces in a plane at right angles to the one piece rim, and a target against which the projectile is to be propelled, said target being of material to which the burr material adheres upon contact so a burr coated surface of the projective is adhered to the target at the point at which the surface strikes the target.

8. A game comprising a projectile having a first cylindrical outer surface coated with burr material and a target against which the projectile is to be propelled, said cylindrical surface being on the felly of a first wheel element and said wheel element having a hub integral with the felly and with said cylindrical surface, two segmental cylindrical outer surfaces concentric with each other and coated with burr material and with ends respectively abutting opposite sides of the first cylindrical surface, said target being of material to which the burr material adheres on contact so a burr coated surface of the projectile is adhered to the target at the point at which the surface strikes the target.

9. A game comprising a projectile having a cylindrical surface which is coated with burr material and a target against which the projectile is to be propelled, said cylindrical surface being on the felly of a first wheel element, said projectile having in addition two segmental wheel elements with fellies in a plane at right angles to the plane of the first wheel element with segmental cylindrical outer surfaces coated with burr material, a hub on the first wheel element, bosses on the segmental wheel elements in line with the hub, interfitting elements on the hub and bosses for fixing the segmental wheel elements to the first wheel element, said target being of a material to which the burr material adheres on contact so a burr coated surface of the projectile is adhered to the target at the point at which the surface strikes the target.

10. A game comprising a projectile having a first wheel element having a rim with a cylindrical outer surface coated with burr material and a target against which the projectile is to be propelled, said first cylindrical outer surface being on the outer part of a disc, the cylindrical surface being interrupted and the disc being recessed inward opposite the interruption, the recess cooperating with the ends of the cylindrical surface at said interruption to form a first detent element, the disc having a slot extending diametrally inward from said recess and terminating in a second detent element on the inner surface of said cylindrical surface and complimentary to the first detent element and extending a right angle to said disc, said target being of a material to which the burr material adheres on contact so a burr coated surface of the projectile is adhered to the target at the point at which the surface strikes the target.

11. The game of claim 10 in which two of the projectiles are assembled in planes at right angles to each other with the detent elements engaged to form a ball.

* * * * *